United States Patent [19]

Vilain

[11] 4,127,003

[45] Nov. 28, 1978

[54] PRODUCTION EQUIPMENT FOR OIL-FIELDS AT SEA

[75] Inventor: Robert Vilain, Maisons Alfort, France

[73] Assignee: Enterprise d'Equipements Mecaniques et Hydrauliques E.M.H., France

[21] Appl. No.: 810,189

[22] Filed: Jun. 27, 1977

[30] Foreign Application Priority Data

Jun. 30, 1976 [FR] France ..... 76 19961

[51] Int. Cl.[2] ..... B63B 35/44; E21B 43/01

[52] U.S. Cl. ..... 405/202; 141/388; 166/362; 405/210

[58] Field of Search ..... 61/95, 101, 48, 86, 61/87; 166/0.5; 137/236; 9/8 P; 141/389, 388; 114/254, 230; 431/202

[56] References Cited

U.S. PATENT DOCUMENTS

| | | | |
|---|---|---|---|
| 3,535,884 | 10/1970 | Chaney | 61/101 |
| 3,656,307 | 4/1972 | Mott | 166/0.5 |
| 3,712,068 | 1/1973 | Liautaud | 61/101 |
| 3,756,293 | 9/1973 | Adler et al. | 137/236 |
| 3,875,998 | 4/1975 | Charpentier | 166/0.5 |
| 3,881,549 | 5/1975 | Thomas | 166/0.5 |

*Primary Examiner*—Jacob Shapiro
*Attorney, Agent, or Firm*—Steinberg & Blake

[57] ABSTRACT

The invention relates to oil-field production equipment. It consists particularly in using a production platform of the type articulated to a base, and which comprises a gas and oil separator while being combined with a flare located at a suitable distance from the axis of the platform, this flare being carried by a floating support turning into the wind, while being connected by at least one arm hinged to rotatable head of the platform. The invention comprises also different arrangements relative to the connection between a drilling platform and a storage and loading platform.

10 Claims, 4 Drawing Figures

PRODUCTION EQUIPMENT FOR OIL-FIELDS AT SEA

The present invention relates to production equipment for oil-fields at sea using off-shore platforms or the like.

Its aim is, by means of a number of arrangements to be used together or separately, to substantially reduce the investment cost of low output installations and to make them workable.

It consists, according to one of these arrangements, in using a production platform, particularly of the type anchored to the bed of the drilling field and, for example, of the type hinged at the base, which platform comprises an oil and gas separator and which is combined with a flare which appears at a suitable distance from the axis of the platform, this flare being carried by a floating support turning into the wind while being connected by at least one hinged arm to a rotatable element, particularly a rotating head of the platform.

Another arrangement consists in connecting by pipeline to a production platform, particularly of the type which has just been specified, the assembly of a storage and loading platform, particularly with a base anchored to the sea-bed and forming a storage reservoir, and at least one column hinged to this base, which column comprises equipment for loading oil tankers.

The above-mentioned production column may be associated with a number of wells distributed about its base or else said wells may be drilled from said base, in combination with systems of valves and manifolds suitable for directing the crude oil towards the separator, then the separated oil towards the storage and loading column.

The invention comprises, apart from these arrangements, certain other arrangements which are preferably used at the same time and which will be explicitly mentioned hereafter.

It concerns more particularly certain modes of application, as well as certain embodiments, of said arrangements; and it concerns more particularly still, by way of novel industrial products, equipment of the kind in question comprising the application of these same arrangements, as well as the special elements adapted to their construction and the installations comprising such equipment.

The invention will, in any case, be well understood from the description which follows and the accompanying drawings, which drawings are of course given principally by way of example.

Figure 1:
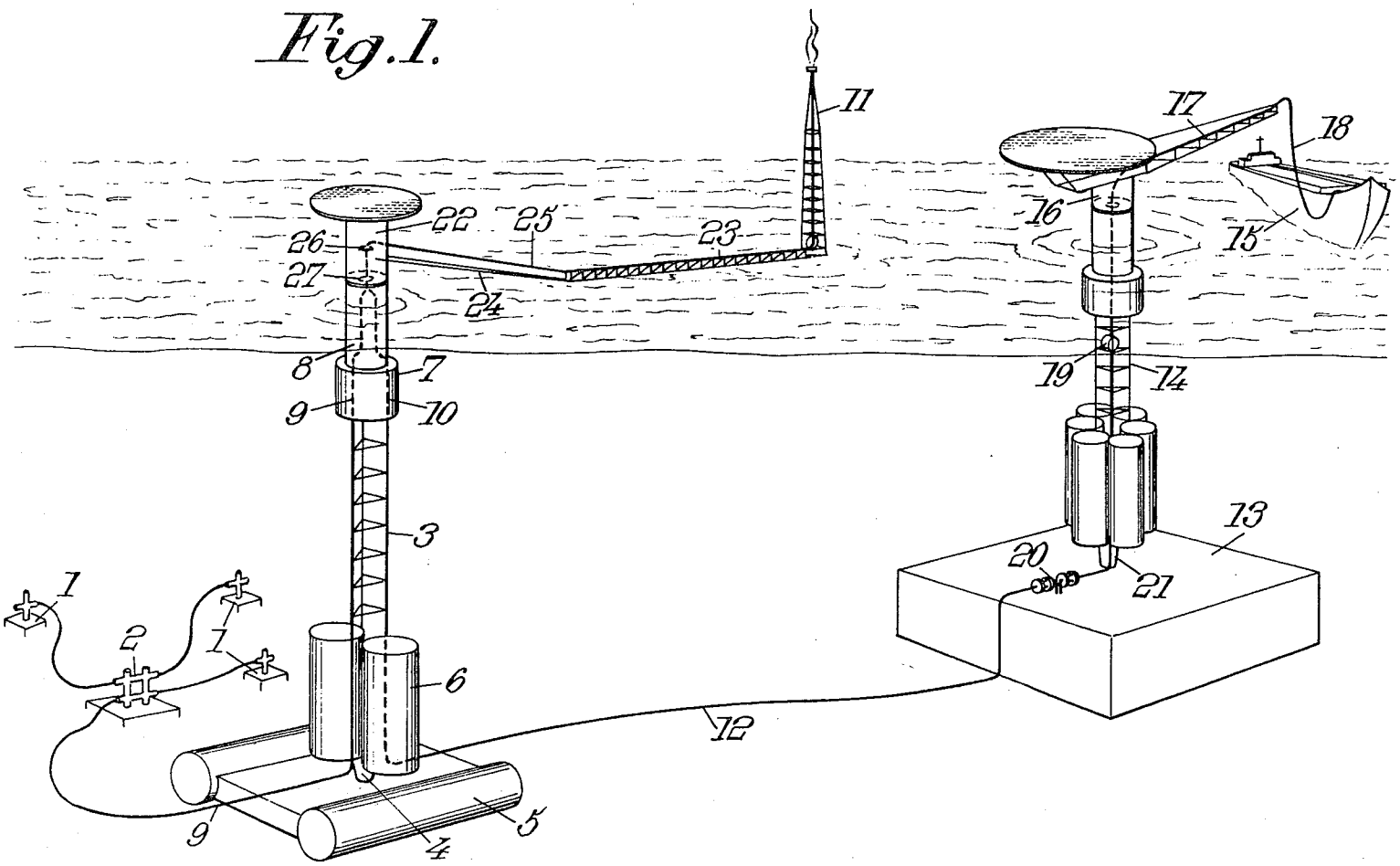

FIG. 1 of these drawings shows schematically in perspective an oil production installation constructed according to the invention.

Figure 2:
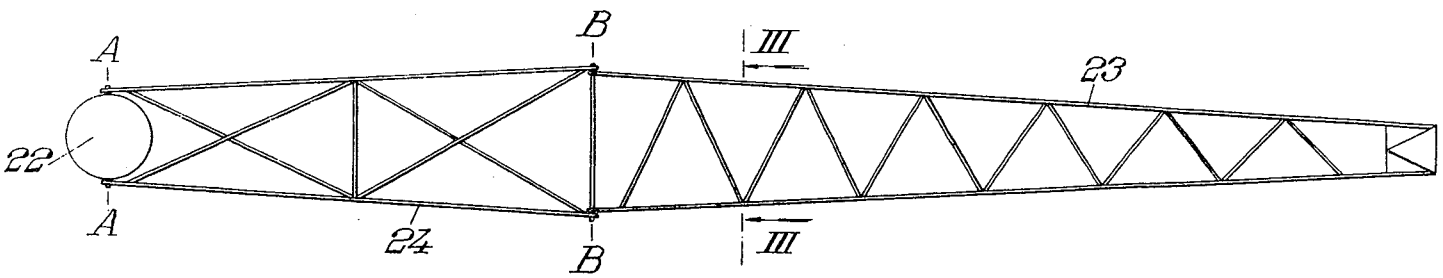
Figure 3:
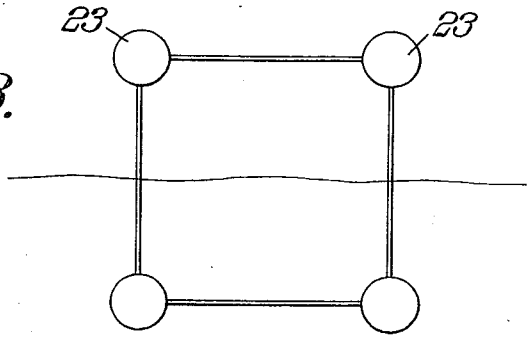

FIGS. 2 and 3 show separately, on a larger scale, the structure supporting the flare comprised in said installation, the whole in conformity with the invention.

Figure 4:
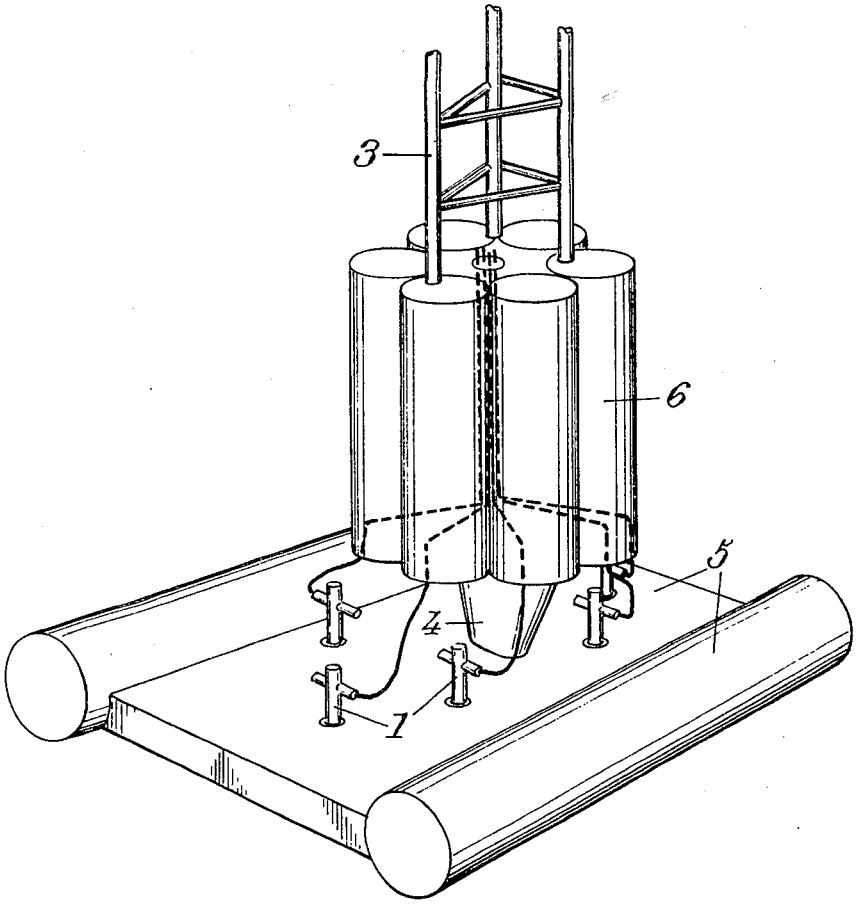

FIG. 4, finally, illustrates in perspective the base of a production column of the type of that of FIG. 1, according to a variation.

The installation of the invention comprises essentially:

a number of wells which are drilled from a mobile platform or from a drilling ship or in any other way, these wells being equipped with their usual accessories, such as protection casings, safety valves etc; their upper part forming the well-heads, shown at 1 in FIG. 1, a manifold device such as 2, in combination with groups of valves and piping, for collecting the production of the wells, these valves being housed on the sea bottom or on the production column which will be described, the production column properly speaking which, according to the most advantageous embodiment, is formed by an articulated column 3, mounted through a universal joint 4 to a base 5, with ballast reservoirs 6 and at least one float 7 maintaining by hydrostatic thrust the substantially vertical position, said column being equipped moreover with a gas and oil separating system 8 to which the crude oil enters through a pipe 9 and from which it leaves, refined, by a pipe 10 going downwards along and then away from the column to convey the refined petroleum, or oil, towards the storing and loading equipment, a flare 11 suitable for burning the gas leaving the separator, and which is preferably constructed in the way described hereafter, and, fed by a pipeline 12 forming a continuation to pipe 10, the storing and loading equipment which is advantageously formed, on the one hand, by a base 13 anchored to the sea-bed, serving as storage reservoir and of any desired size and, on the other hand, by a loading platform constructed advantageously in the form of a column 14 pivoted to base 13 by universal joint at 21 and equipped with means for mooring ships 15, with particularly a rotatable head 16 and a boom 17 for carrying loading tubes 18, the whole being of course combined with pumps 19 and valves 20 for taking the oil from the reservoir-base 13, at will, or on the contrary for stocking it therein.

As far as flare 11 is more especially concerned, it is constructed in such a way that, in accordance with one of the arrangements of the invention, it is located at some distance from the production column (e.g. 100 to 200 m), while being carried by a floating structure capable of turning into the wind, this structure being connected to the platform so as to be able to rotate thereabout, and it is for this very reason that the platform is equipped with a rotatable head 22 on which is hinged an arm connecting this head to said floating structure.

Floating structure 23 carrying at one end flare 11, is formed advantageously by an assembly, having a generally square or triangular or other section, of suitably cross-braced tubes, such a structure being insensitive to the effects of swell. It is connected to rotating head 22 by at least one arm 24, itself formed by tubes, which at its ends hingedly bears, on the one hand, on head 22 about a horizontal axis A—A and, on the other hand, on structure 23 about another horizontal axis B—B (FIG. 2).

The dimensions of the tubes of structure 23 will be calculated so that the water line is substantially halfway up the vertical section, as shown in FIG. 3.

The tubes in question could possibly be used for conveying gas, but it seems preferable for safety reasons to use separate piping such as 25 whose end on the column side is connected to the output tube of the separator by means of rotating joints schematically shown at 26, 27.

Such a structure is subjected by the sea, even in the case of storms, to much less heavy stress than a normal boat. It will be in fact noted that the swinging movement of the articulated column will be braked by the movements of this structure in the water and that the result of this will be, in connecting arm 24 and its joints, stresses which remain small whereas they could become very great if flare 11 had the shape and the mass of a boat of the same length (the solution of a support forming a boat hull not however being excluded).

In FIG. 4 is shown another embodiment of the installation in which the well-heads are fixed through base 5 of the production column, in the case where this base has large dimensions (50 to 100 m per side).

In this case, the base alone is installed first of all and the wells are drilled at the positions provided therefor by means of a mobile platform of a known type carrying drilling equipment and using the technique of deflected wells so as to attain the full volume of the oil-field.

After the wells are finished and fitted with their control members, the articulated production column is installed and the oil collecting piping connected between the base and the column.

The advantage of this embodiment is that it becomes possible, by using simple and economical equipment carried by the column, to carry out on and inside the well-heads all maintenance work which may prove necessary.

In this connection the column will be able to comprise all service means for control and possible loading of the well-heads and/or their accessories (valves etc.)

Following which, whatever the embodiment adopted, the invention provides oil-field production equipment whose operation is sufficiently clear from what has gone before and which presents, in relation to those of the kind in question already existing, numerous advantages, particularly:

that of concentrating to the maximum, on the platforms considered, the different essential members, that, consequently, of reducing construction costs, even for platforms in deep water (e.g. 100 to 200 m), that of permitting the production of several days to be readily stocked when bad weather prevents an oil tanker from coming to take it away, base 13 and the production column being able to have a large capacity, and that of ensuring a better supervision of the different parts of the whole.

As is evident, the invention is in no wise limited to those of its modes of application and embodiments which have been more specially considered; it covers on the contrary all variations thereof.

Thus, it will be seen that with the structure of the invention, the elongated column means 3 is articulated at its bottom end to the base means 5, which rests on the sea bed, by way of the joint 4, while the top end region of the column means 3 extends above the level of the sea where it carries a rotary head means 22 capable of rotating about the axis of the column means 3. The structure 23 forms a floating means capable of floating on the sea and carrying at an outer end the flare means 11 while being operatively connected at its opposed inner end, by way of the connecting means 24, to the rotary head means 22 so as to turn therewith about the axis of the column means 3 while floating on the sea and supporting the flare means 11 distant from the rotary column means 3. In this way not only is the flare means 11 situated distant from the column means 3, but in addition the floating means 23 acts, as set forth above, to brake the movement of the column means 3. The column means 3 is of course a production column means carrying above the base means 5 a separator means 8 which receives by way of the conduit means 9 crude oil from the well head means 1 while delivering gas to the flare means 11 through a conduit means 25 and directing oil separated from gas downwardly along the conduit means 10 which extends downwardly along the column means 3 toward the base means 5. At the lower region of the column means 3 the conduit means 10 communicates with the conduit means 12 which delivers the refined oil to the second base means 13 to which the bottom end of a second column means 14 is articulated by way of the joint 21, the oil being delivered from the conduit means 12 to the conduit means 18 which is supported by the boom 17 connected to the rotary head means 16 at the top of the column means 14, so that through the conduit means 18 it is possible to deliver the oil to a vessel 15, as described above.

I claim:

1. In an offshore oil-well installation, base means situated at the bottom of the sea, column means extending upwardly from said base means to an elevation above sea level, said column means having a bottom end articulated to said base means and having above sea level a top end carrying a rotatable head means for turning about the axis of said column means, floating means floating on the sea and carrying distant from said column means a flare means for burning gas, and connecting means connecting said floating means to said head means for turning therewith, so that said floating means on the one hand maintains said flare means distant from said column means and on the other hand brakes the swinging movement of said column means with respect to said base means.

2. The combination of claim 1 and wherein said floating means has an elongated configuration and has an outer end carrying said flare means while having an inner end nearer to said column means than said outer end, said connecting means extending between said head means and said inner end of said floating means.

3. The combination of claim 2 and wherein said floating means is in the form of an elongated assembly of cross-braced tubular arms some of which are hollow and form floats for said floating means.

4. The combination of claim 3 and wherein said connecting means includes elongated arms hinged to said head means and also hinged to said inner end of said floating means.

5. The combination of claim 4 and wherein a conduit means extends along and is carried by said connecting means and floating means for delivering to said flare means gas to be burned at said flare means.

6. The combination of claim 1 and wherein said column means carries above said base means a separating means for separating oil and gas, supply conduit means extending from a plurality of wells upwardly along said column means to said separating means for delivering thereto crude oil to be separated into gas and refined oil, conduit means carried in part by said floating means and extending from said separating means to said flare means to deliver said gas thereto to be burned at said flare means, delivery conduit means extending from said separating means downwardly along said column means to carry refined oil from said separating means downwardly along said column means toward said base means, second base means distant from said first-mentioned base means and second column means extending upwardly from said second base means and having a bottom end articulated thereto, said second column means forming part of a loading platform, and connecting conduit means extending from said delivery conduit means away from said first-mentioned base means to said second base means and travelling upwardly along said second column means for delivering refined oil to a vessel from said loading platform.

7. The combination of claim 1 and wherein said base means also forms a storage reservoir.

8. The combination of claim 7 and wherein a plurality of wells extend upwardly through said base means.

9. The combination of claim 1 and wherein said floating means is in the form of an elongated assembly of cross-braced tubular arms at least some of which form floats for supporting said floating means at the surface of the sea in a condition where said floating means is only partly submerged beneath the surface of the sea.

10. The combination of claim 9 and wherein said floating means has an outer end distant from said column means and carrying said flare means and an opposed inner end to which said connecting means is operatively connected, said connecting means being in the form of an elongated frame work hingedly connected at one end to said inner end of said floating means for providing a horizontal turning axis between said connecting means and floating means and turnably connected at an opposite end to said head means also for turning movement with respect thereto about a horizontal axis.

* * * * *